US009302502B2

(12) United States Patent
Sasaki

(10) Patent No.: US 9,302,502 B2
(45) Date of Patent: Apr. 5, 2016

(54) RECORDING APPARATUS AND RECORDING METHOD

(71) Applicant: SEIKO EPSON CORPORATION, Tokyo (JP)

(72) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/196,168

(22) Filed: Mar. 4, 2014

(65) Prior Publication Data

US 2014/0253653 A1 Sep. 11, 2014

(30) Foreign Application Priority Data

Mar. 8, 2013 (JP) ..... 2013-046716

(51) Int. Cl.

| | |
|---|---|
| ***B41J 2/01*** | (2006.01) |
| ***B41J 11/00*** | (2006.01) |
| ***B41M 7/00*** | (2006.01) |
| ***B41J 3/407*** | (2006.01) |

(52) U.S. Cl.

CPC ..... *B41J 11/0015* (2013.01); *B41J 3/4078* (2013.01); *B41J 11/002* (2013.01); *B41M 7/009* (2013.01)

(58) Field of Classification Search

CPC ..... B41J 11/002; B41J 11/0015; B41M 7/00–7/009; B41F 23/0403–23/0496; F26B 25/005–25/007

USPC ..... 347/102; 101/424.1, 487–488; 34/273, 34/292, 414, 419; 219/216; 346/25

See application file for complete search history.

(56) References Cited

U.S. PATENT DOCUMENTS

| | | | | |
|---|---|---|---|---|
| 2,795,054 | A * | 6/1957 | Bowen, III | 34/514 |
| 4,959,529 | A * | 9/1990 | Matsumoto et al. | 219/388 |
| 5,020,244 | A * | 6/1991 | Smith | 34/633 |
| 5,047,798 | A * | 9/1991 | Yamamoto et al. | 355/405 |
| 7,086,727 | B2 * | 8/2006 | Nishikawa et al. | 347/102 |

(Continued)

FOREIGN PATENT DOCUMENTS

| | | |
|---|---|---|
| JP | 10-310986 | 11/1998 |
| JP | 2000-280546 | 10/2000 |
| JP | 2007-331169 | 12/2007 |

(Continued)

OTHER PUBLICATIONS

Greenheck Engineering update Fall 2004/Winter 2005, vol. VI, lssuue 1, pp. 1-4, downloaded from http://old.greenheck.com/technical/files/engineering/04fall_eng.pdf.*

(Continued)

*Primary Examiner* — Shelby Fidler
*Assistant Examiner* — Tracey McMillion
(74) *Attorney, Agent, or Firm* — Workman Nydegger

(57) ABSTRACT

A recording apparatus has a recording head capable of performing recording by discharging an aqueous ink to a target recording medium, a drying portion which dries the aqueous ink recorded on the target recording medium by the recording head, a collecting portion which collects vapor at least containing water evaporated from the aqueous ink by the drying portion, a heating and compressing portion of heating and compressing the vapor collected by the collecting portion, and an ejecting portion of ejecting the vapor heated and compressed by the heating and compressing portion to the target recording medium on which recording is performed.

7 Claims, 5 Drawing Sheets

(56) References Cited

U.S. PATENT DOCUMENTS

| | | | | |
|---|---|---|---|---|
| 7,237,886 | B2 * | 7/2007 | Maekawa et al. | 347/100 |
| 8,684,510 | B2 * | 4/2014 | Miyamoto et al. | 347/102 |

FOREIGN PATENT DOCUMENTS

| | | |
|---|---|---|
| JP | 2010-137519 | 6/2010 |
| JP | 2010-158861 | 7/2010 |
| JP | 2011-083950 | 4/2011 |

OTHER PUBLICATIONS

Tsuda, Naoaki, Image Forming Apparatus, Jun. 2010, Japan, 2010137519A.*

European Search Report for Application No. 14158104.1 dated Jun. 18, 2014.

* cited by examiner

RECORDING APPARATUS AND RECORDING METHOD

BACKGROUND

1. Technical Field

The present invention relates to a recording apparatus having a drying portion which dries ink of a target recording medium on which recording is performed with the ink and a recording method.

2. Related Art

Heretofore, a recording apparatus having a drying portion which dries ink of a recording medium on which recording is performed with the ink has been used. For example, JP-A-2000-280546 discloses a recording apparatus capable of drying ink of a target recording medium on which recording is performed by heating a platen which is a support portion of the target recording medium with a heater to warm the target recording medium.

Moreover, heretofore, a recording apparatus requiring steaming treatment by vapor steaming or the like after performing recording on cloth or the like as a target recording medium has been used. For example, JP-A-10-310986 discloses a recording apparatus capable of forming a roll of a shape conforming to a steaming chamber of a simple steaming unit in a target recording medium on which recording is performed.

However, with the former recording apparatus having the drying portion disclosed in JP-A-2000-280546, the dryability of the ink on the target recording medium on which recording is performed with the ink has not insufficient in some cases.

Moreover, a recording method employing the former recording apparatus disclosed in JP-A-10-310986 has generally included performing recording with the recording apparatus, and then separately performing the steaming treatment of the target recording medium on which recording is performed in another apparatus. Therefore, it has been demanded to achieve the steaming treatment of the target recording medium with a simple configuration.

SUMMARY

An advantage of some aspects of the invention is to increase the dryability of ink on a target recording medium on which recording is performed with the ink and achieve steaming treatment of the target recording medium with a simple configuration.

A recording apparatus of a first aspect of the invention for solving the problems has: a recording head capable of performing recording by discharging an aqueous ink to a target recording medium, a drying portion which dries the aqueous ink recorded on the target recording medium by the recording head, a collecting portion which collects vapor at least containing water evaporated from the aqueous ink by the drying portion, a heating and compressing portion of heating and compressing the vapor collected by the collecting portion, and an ejecting portion of ejecting the vapor heated and compressed by the heating and compressing portion to the target recording medium on which recording is performed.

Herein, the "aqueous ink" means an ink containing water as a solvent of a coloring material or the like.

According to this aspect, the vapor at least containing water derived from the aqueous ink is collected, the vapor is heated and compressed, and then the heated and compressed vapor is ejected to the target recording medium. When the vapor at least containing water is heated and compressed, and then the heated and compressed vapor is ejected to the target recording medium on which recording is performed, the dryability of the aqueous ink improves in the ejected portion and also steaming treatment of the target recording medium is performed. Therefore, with a simple configuration, the dryability of the aqueous ink on the target recording medium on which recording is performed by the aqueous ink improves and the steaming treatment of the target recording medium can be performed.

In a recording apparatus of a second aspect of the invention in the first aspect, the aqueous ink contains a water-soluble organic solvent and the vapor contains the water-soluble organic solvent.

According to this aspect, the vapor contains the water-soluble organic solvent. Therefore, due to the fact that the water-soluble organic solvent acts on the surface of the aqueous ink recorded on the target recording medium, the leveling properties of a portion where the aqueous ink is recorded on the target recording medium improves and the glossiness of the portion where the aqueous ink is recorded improves.

A recording apparatus of a third aspect of the invention in the first or second aspect has an emitting portion capable of emitting the vapor to the outside.

According to this aspect, since the emitting portion capable of emitting the vapor to the outside is provided, it can be configured so that the collection, the heating and compressing, and the ejection of the vapor to the target recording medium on which recording is performed are not performed when performing recording on a target recording medium which does not require the steaming treatment, other than cloth. More specifically, it can be switched whether or not the collection, the heating and compressing, and the ejection of the vapor to the target recording medium on which recording is performed according to the target recording medium to be used.

In a recording apparatus of a fourth aspect of the invention in any one of the first aspect to the third aspect, the recording apparatus has a transporting portion capable of intermittently transporting the target recording medium, the recording head can perform recording on the target recording medium by being carried on a carriage which can move back and forth in a direction intersecting the transporting direction of the target recording medium to scan back and forth, and the ejecting portion ejects the vapor when the target recording medium stops in the intermittent transportation of the target recording medium by the transporting portion.

According to this aspect, the ejecting portion ejects the vapor when the target recording medium stops in the intermittent transportation of the target recording medium by the transporting portion. Since the vapor is ejected when the target recording medium stops, sufficient ejecting time can be secured in each portion of the target recording medium and ejection unevenness of the vapor accompanied with the intermittent transportation of the target recording medium can be suppressed.

In a recording apparatus of a fifth aspect of the invention in any one of the first aspect to the fourth aspect, the recording apparatus has a transporting portion of the target recording medium and the ejecting portion ejects the vapor to the downstream side of the transporting direction of the target recording medium.

According to this aspect, a backward flow of the vapor to the upstream side of the transporting direction of the target recording medium can be suppressed. Therefore, it can be suppressed that the vapor flows to the drying portion due to the backward flow to cause temperature unevenness in the target recording medium near the drying portion to cause drying unevenness of the aqueous ink and the like.

A recording method of the sixth aspect of the invention has: a recording process of discharging an aqueous ink from a recording head to a target recording medium to perform recording, a drying process of drying the aqueous ink recorded on the target recording medium by the recording head, a collecting process of collecting vapor at least containing water evaporated from the aqueous ink by the drying process, a heating and compressing process of heating and compressing the vapor collected by the collecting process, and an ejecting process of ejecting the vapor heated and compressed in the heating and compressing process to the target recording medium on which recording is performed.

According to this aspect, the vapor at least containing water derived from the aqueous ink is collected, the vapor is heated and compressed, and then the heated and compressed vapor is ejected to the target recording medium. Therefore, with a recording apparatus with a simple configuration, the dryability of the aqueous ink on the target recording medium on which recording is performed by the aqueous ink improves and the steaming treatment of the target recording medium can be performed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Example 1

Figure 1:
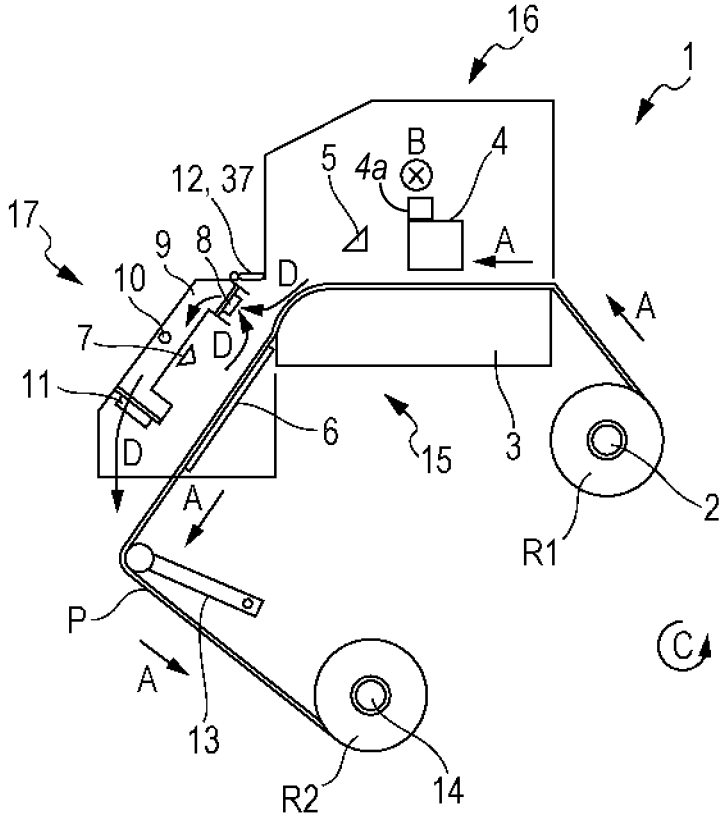
FIG. 1 is a schematic side surface view illustrating a recording apparatus according to Example 1 of the invention.
Figure 2:
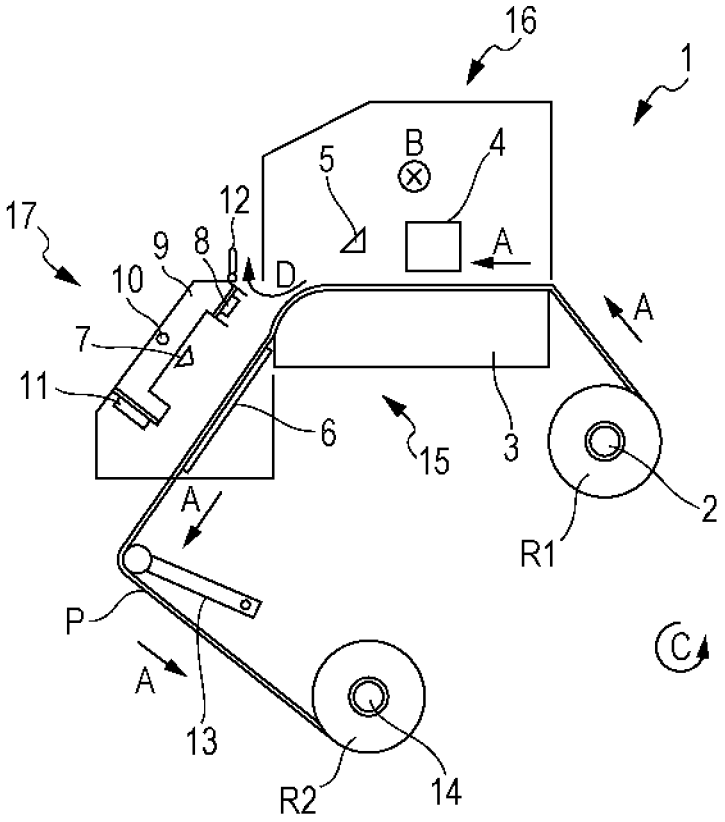
FIG. 2 is a view illustrating a state where an emitting portion in the recording apparatus according to Example 1 of the invention is released.
Figure 3:
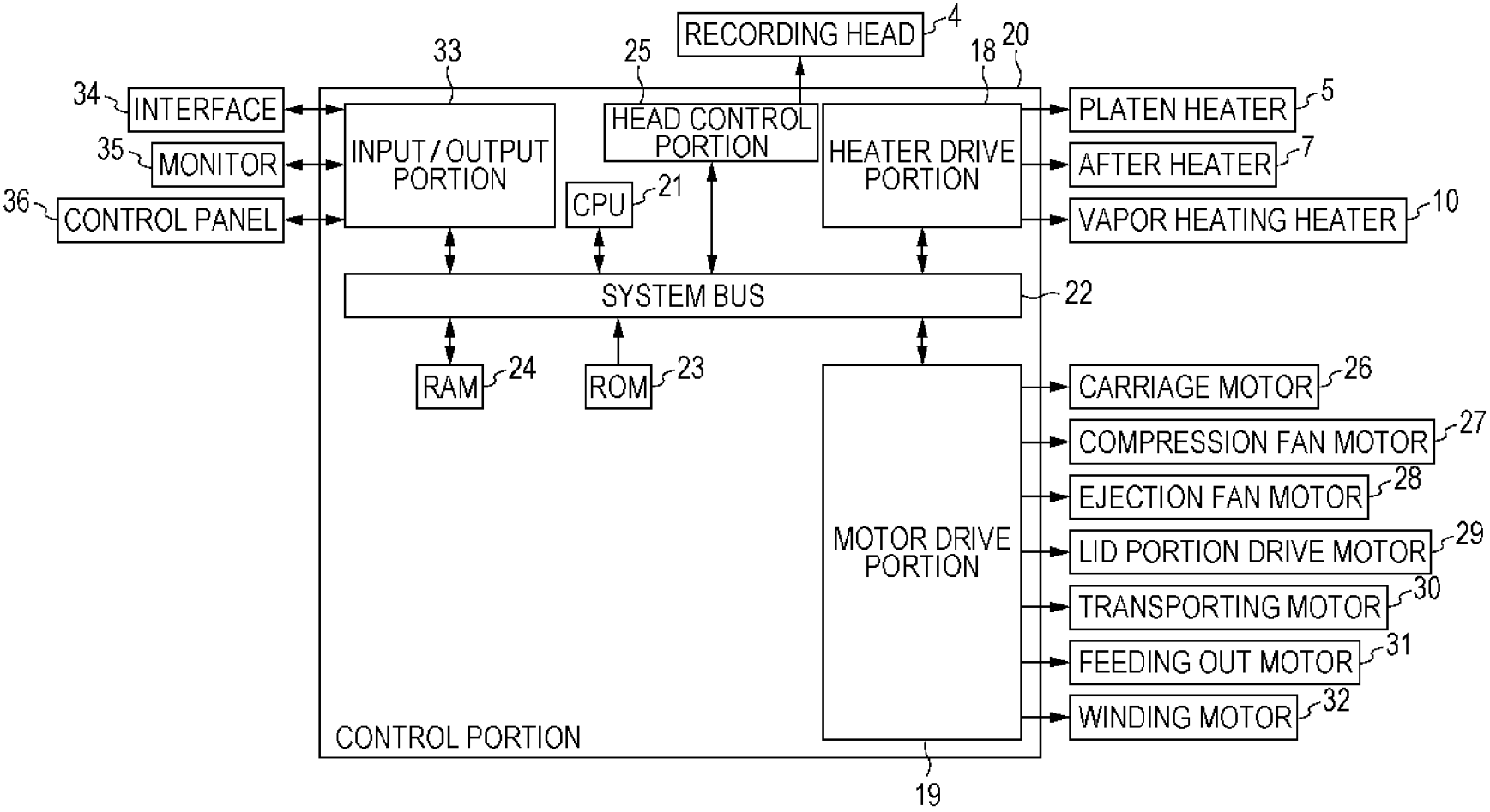
FIG. 3 is a block diagram of the recording apparatus according to Example 1 of the invention.

FIGS. 1 to 3

Hereinafter, a recording apparatus according to Examples of the invention is described in detail with reference to the attached drawings.

First, a recording apparatus according to Example 1 of the invention is described. The recording apparatus is a recording apparatus capable of performing recording on a target recording medium with an aqueous ink.

FIG. 1 illustrates a schematic side surface view of a recording apparatus 1 according to Example 1 of the invention.

The recording apparatus 1 of this example has a set portion 2 of a target recording medium P capable of feeding out a roll R1 of the target recording medium P for recording. The recording apparatus 1 of this example employs a roll-type target recording medium as the target recording medium P but is not limited to a recording apparatus employing such a roll-type target recording medium.

When the recording apparatus 1 of this example transports the target recording medium P in a transporting direction A, the set portion 2 rotates in a rotation direction C.

The recording apparatus 1 of this example has a transporting mechanism 15 having a plurality of transporting rollers, which are not illustrated, for transporting the roll-type target recording medium P in the transporting direction A. The transporting mechanism 15 as a transporting portion is provided with a platen heater 5 capable of heating the target recording medium P supported by a platen 3.

The platen heater 5 of this example is provided at a position facing the platen 3 and is an infrared heater capable of heating the surface of the target recording medium P from 35° C. to 50° C. but is not limited to such a heater. A heater capable of heating the target recording medium P from the platen 3 side may be used.

The recording apparatus 1 of this example has a recording mechanism 16 which causes a recording head 4 to scan back and forth in a scanning direction B intersecting the transporting direction A of the target recording medium P to perform recording. The recording apparatus 1 of this example has the recording mechanism 16 which causes the recording head 4 to scan back and forth to perform recording but may be a recording apparatus having a so-called line head in which a plurality of nozzles which discharges ink are provided in a direction intersecting the transporting direction A.

On the downstream side in the transporting direction A of the target recording medium P of the transporting mechanism 15 and the recording mechanism 16, a drying mechanism 17 which dries the target recording medium P transported by a medium support portion 6 by an after heater 7 constituted by an infrared heater as a drying portion. The drying mechanism 17 has a compression FAN 8 as a collecting portion which collects vapor at least containing water which is evaporated from an aqueous ink by the after heater 7. In order to cure a thermosetting resin contained in the aqueous ink of this example, the after heater 7 is an infrared heater capable of heating the surface of the target recording medium P from 60° C. to 120° C. but is not limited to such a heater. Moreover, a vapor heating heater 10 is provided and a heating and compressing portion 9 which heats and compresses the vapor collected by the compression FAN 8 is provided. Moreover, an ejection FAN 11 as an ejecting portion which ejects the vapor heated and compressed by the heating and compressing portion 9 to the target recording medium P on which recording was performed. When performing recording on the target recording medium P requiring no steaming treatment other than cloth, for example, a lid portion 12 as an emitting portion 37 capable of emitting the vapor to the outside is provided in order not to perform the collection of the vapor and the ejection thereof to the target recording medium P which was heated and compressed and on which recording was performed.

FIG. 1 illustrates a state where recording is performed on cloth requiring steaming treatment as the target recording medium P and a state where the lid portion 12 is closed and the vapor is collected and ejected to the target recording medium P which was heated and compressed and on which recording was performed. In this case, the vapor moves in a direction D in FIG. 1.

In the recording apparatus 1 of this example, the ejection FAN 11 ejects the vapor of 100° C. or higher and 150° C. or less to the target recording medium at 3 $m^2$/hour or more and 20 $m^2$/hour or less. Then, as illustrated in FIG. 1, the vapor is ejected to the downstream side of the transporting direction A. Therefore, it can be suppressed that the vapor flows to the vicinity of the after heater 7 due to a backward flow of the vapor to cause temperature unevenness in the target recording medium P near the after heater 7 to cause dry unevenness of the aqueous ink and the like. However, the example of the invention is not limited to such a configuration.

The recording apparatus 1 of this example has the recording mechanism 16 which causes the recording head 4 to scan back and forth to perform recording and the transporting mechanism 15 is configured to be able to intermittently transport the target recording medium P corresponding to the recording mechanism of such a configuration. The ejection FAN 11 ejects the vapor by the control of a control portion 20 (FIG. 3) when the target recording medium P stops in the intermittent transportation of the target recording medium P by the transporting mechanism 15.

The aqueous ink used in the recording apparatus 1 of this example contains a water-soluble organic solvent and the vapor contains the water-soluble organic solvent besides water. Therefore, due to the fact that the water-soluble organic solvent acts on the surface of the aqueous ink recorded on the target recording medium P, the leveling properties of a portion where the aqueous ink was recorded on the target recording medium P improves and the glossiness of a portion where the aqueous ink was recorded improves.

On the downstream side in the transporting direction A of the target recording medium P of the drying mechanism 17, a tension adjustment portion 13 having a function of adjusting the tension of the target recording medium P when winding the target recording medium P is provided. On the downstream side in the transporting direction A of the target recording medium P of the tension adjustment portion 13, a winding portion 14 capable of winding the target recording medium P is provided. In the recording apparatus 1 of this example, when winding the target recording medium P, the winding portion 14 rotates in the rotation direction C.

Next, a case where recording is performed on the target recording medium P requiring no steaming treatment other than cloth, for example, and where the collection of the vapor and the ejection thereof to the target recording medium P which was heated and compressed and on which recording was performed are not performed is described.

FIG. 2 is a view illustrating a state where the lid portion 12 as the emitting portion in the recording apparatus 1 of this example is opened and released.

As illustrated in FIG. 2, when recording is performed on the target recording medium P requiring no steaming treatment, the lid portion 12 is opened. In this case, the compression FAN 8 and the ejection FAN 11 are not driven. By setting the recording apparatus into such a state, the air in the recording apparatus moves in a direction D in FIG. 2.

Next, an electrical configuration in the recording apparatus 1 of this example is described.

FIG. 3 is a block diagram of the recording apparatus 1 of this example.

The control portion 20 is provided with a CPU 21 which controls the entire recording apparatus 1. The CPU 21 is connected to a ROM 23 storing various control programs and the like which are executed by the CPU 21 and a RAM 24 capable of temporarily storing data through a system bus 22. The CPU 21 is connected to a head actuator 25 for driving the recording head 4 through the system bus 22.

The CPU 21 is connected to a heater actuator 18 for driving the platen heater 5, the after heater 7, and the vapor heating heater 10 through the system bus 22.

The CPU 21 is connected to a motor actuator 19 for driving a carriage motor 26, a compression FAN motor 27, an ejection FAN motor 28, a lid portion drive motor 29, a transporting motor 30, a feeding out motor 31, and a winding motor 32 through the system bus 22.

Herein, the carriage motor 26 is a motor for moving a carriage 4*a* carrying the recording head 4. The compression FAN motor 27 is a motor for driving the compression FAN 8. The ejection FAN motor 28 is a motor for driving the ejection FAN 11. The lid portion drive motor 29 is a motor for driving the lid portion 12 when opening and closing of the lid portion 12. The transporting motor 30 is a motor for driving a plurality of transporting rollers, which are not illustrated, provided in the transporting mechanism 15. The feeding out motor 31 is a rotating mechanism of the set portion 2 and is a motor which drives the set portion 2 to feed out the target recording medium P to the transporting mechanism 15. The winding motor 32 is a drive motor for rotating the winding portion 14.

The CPU 21 is connected to a monitor 35 and a control panel 36 provided in the recording apparatus 1, an interface 34 for, for example, inputting recording data and the like from an external apparatus, such as PC, and an input/output portion 33 for transmitting and receiving data and signals.

Example 2

FIG. 4

Next, a recording apparatus according to Example 2 of the invention is described.

Figure 4:
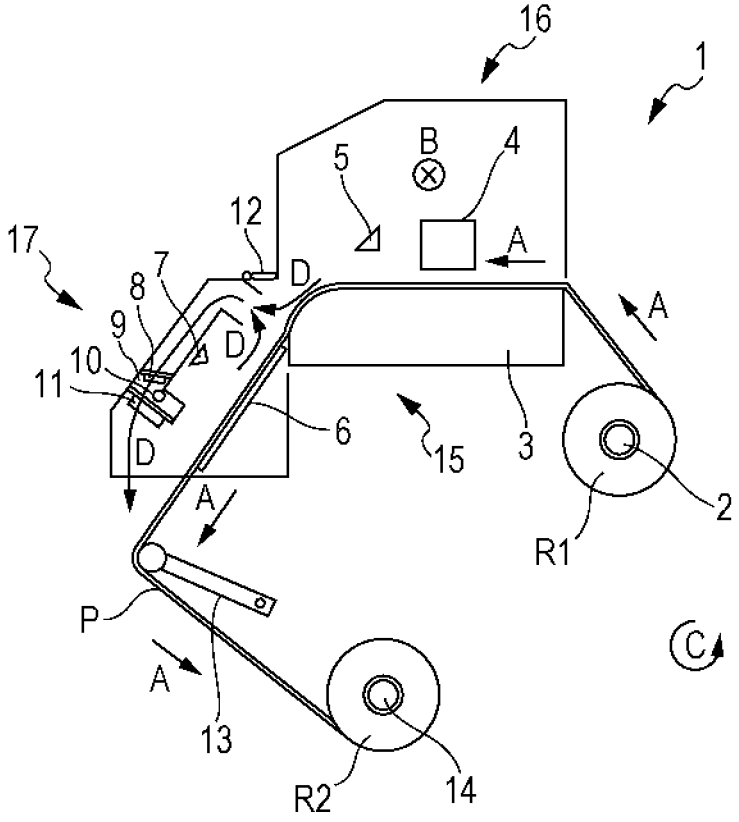
FIG. 4 is a schematic side surface view illustrating a recording apparatus according to Example 2 of the invention.

FIG. 4 is a schematic side surface view of the recording apparatus 1 according to Example 2 of the invention. Constituent members common to those of Example above are denoted by the same reference numerals, and a detailed description thereof is omitted.

The recording apparatus 1 of this example is different from the recording apparatus 1 of Example 1 only in a respect that the heating and compressing portion 9 is small because the positions of the compression FAN 8 and the vapor heating heater 10 are different from those of Example 1. Since the heating and compressing portion 9 of this example is smaller than the heating and compressing portion 9 of Example 1, the heating and compressing effect can be further increased in a short time.

Aqueous Ink

Next, an aqueous ink usable in the invention is described.

The aqueous ink usable in the invention is one suitably used in the recording apparatus 1 of an ink jet system of Examples above. Although one containing a water-soluble organic solvent and resin besides water as a main solvent is preferable, one substantially not containing glycerin among water-soluble organic solvents is preferable.

The aqueous ink used in the recording apparatus 1 does not substantially contain glycerin whose boiling point under one atmospheric pressure is 290° C. When the ink substantially contains glycerin, the dryability of the ink sharply decreases. As a result, density unevenness of an image is noticeable and ink fixability is not obtained on various target recording media P, particularly a target non-ink-absorbing or low-ink-absorbing recording medium P. Furthermore, it is preferable not to substantially contain alkylpolyols (excluding glycerin above) whose boiling point under a pressure equivalent to one atmospheric pressure is 280° C. or higher.

Herein, the description of "does not substantially contain" in this specification means that a substance is not compounded in a proportion equal to or higher than a proportion which achieves sufficient demonstration of the meaning of adding the substance. Quantitatively, glycerin is not contained in a proportion of preferably 1.0% by mass or more, more preferably 0.5% by mass or more, still more preferably 0.1% by mass or more, yet still more preferably 0.05% by mass or more, particularly preferably 0.01% by mass or more, and most preferably 0.001% by mass or more based on the total mass (100% by mass) of the ink.

Hereinafter, additives (components) which are or may be contained in the aqueous ink usable in the invention are described.

1. Coloring Material

The aqueous ink usable in the invention may also contain a coloring material. The coloring material is selected from pigments and dyes.

1-1. Pigment

By using a pigment as the coloring material, the lightfastness of the ink can be increased. As the pigment, both an inorganic pigment and organic pigment can be used.

The inorganic pigment is not particularly limited and, for example, includes carbon black, iron oxide, titanium oxide, and silica oxide.

The organic pigment is not particularly limited and, for example, includes quinacridone pigments, quinacridone quinone pigments, dioxazine pigments, phthalocyanine pigments, anthrapyrimidine pigments, anthanthrone pigments, indanthrone pigments, flavanthrone pigments, perylene pigments, diketopyrrolopyrrole pigments, perinone pigments, quinophthalone pigments, anthraquinone pigments, thioindigo pigments, benzimidazolone pigments, isoindolinone pigments, azomethine pigments, and azo pigments. The following substances are mentioned as a specific example of the organic pigment.

As pigments for use in cyan ink, C.I. Pigment Blue 1, 2, 3, 15, 15:1, 15:2, 15:3, 15:4, 15:6, 15:34, 16, 18, 22, 60, 65, and 66, C.I. Vat Blue 4, and 60, and the like are mentioned. Among the above, at least any one of C.I. Pigment Blue 15:3 and 15:4 is preferable.

As pigments for use in magenta ink, C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48(Ca), 48(Mn), 57(Ca), 57:1, 88, 112, 114, 122, 123, 144, 146, 149, 150, 166, 168, 170, 171, 175, 176, 177, 178, 179, 184, 185, 187, 202, 209, 219, 224, 245, 254, and 264, C.I. Pigment Violet 19, 23, 32, 33, 36, 38, 43, and 50, and the like are mentioned. Among the above, it is preferable to contain one or more kinds selected from the group consisting of C.I. Pigment Red 122, C.I. Pigment Red 202, and C.I. Pigment Violet 19.

As pigments for use in yellow ink, C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, and 213 and the like are mentioned. Among the above, it is preferable to contain one or more kinds selected from the group consisting of C.I. Pigment Yellow 74, 155, and 213.

As pigments for use in inks of colors other than the colors mentioned above, such as green ink and orange ink, known pigments are mentioned.

The average particle diameter of the pigment is preferably 250 nm or less because clogging of nozzles can be suppressed and better discharge stability is achieved. The average particle diameter in this specification is one based on volume. As the measuring method, the average particle diameter can be measured with a particle size distribution meter employing a laser diffraction scattering method as the measurement principle, for example. As the particle size distribution meter, a particle size distribution meter employing a dynamic light scattering method as the measurement principle (for example, Microtrac UPA manufactured by Nikkiso Co., Ltd.) is mentioned, for example.

1-2. Dye

In the aqueous ink usable in the invention, dyes can be used as the coloring material. The dyes are not particularly limited and acid dyes, direct dyes, reactive dyes, and basic dyes can be used.

The content of the coloring material is preferably 0.4% by mass or more and 12% by mass or less and more preferably 2% by mass or more and 5% by mass or less based on the total mass (100% by mass) of the ink composition.

2. Resin

The aqueous ink usable in the invention may contain resin. Due to the fact that the ink contains resin, a resin coating film is formed on the target recording medium P, and, as a result, effects of sufficiently fixing the ink on the target recording medium P and achieving good abrasion resistance of a record image are demonstrated. Therefore, the resin emulsion is preferably a thermoplastic resin.

The thermal deformation temperature of the resin is preferably 40° C. or higher and more preferably 60° C. or higher because advantageous effects of making it difficult to cause clogging of a head and achieving good abrasion resistance of a recorded substance are obtained.

Herein, the "thermal deformation temperature" in this specification is a temperature value indicated by the glass transition temperature (Tg) or the minimum film forming temperature (MFT). More specifically, the description that "the thermal deformation temperature is 40° C. or higher" means that either Tg or MFT may be 40° C. or higher. Since superiority or inferiority of the re-dispersibility of the resin is more easily grasped by the MFT than by the Tg, the thermal deformation temperature is preferably a temperature value indicated by the MFT. In the case of the ink excellent in the re-dispersibility of resin, the ink does not firmly stick, and therefore clogging of the head 31 is difficult to occur.

The Tg in this specification is indicated by a value measured by a differential scanning calorimetry method. The MFT in this specification is indicated by a value measured by ISO 2115:1996 (Title: Plastics—Polymer dispersions—Determination of white point temperature and minimum film-forming temperature).

The thermoplastic resin is not particularly limited and a specific example thereof includes (meth)acrylic polymers, such as poly(meth)acrylic acid ester or a copolymer thereof, polyacrylonitrile or a copolymer thereof, polycyanoacrylate, polyacrylamide, and poly(meth)acrylic acid, polyolefin polymers, such as polyethylene, polypropylene, polybutene, polyisobutylene, and polystyrene, copolymers thereof, petroleum resin, coumarone-indene resin, and terpene resin, vinyl acetate or vinyl alcohol polymers, such as polyvinyl acetate or a copolymer thereof, polyvinyl alcohol, polyvinyl acetal, and polyvinyl ether, halogen containing polymers, such as polyvinyl chloride or a copolymer thereof, polyvinylidene chloride, fluororesin, and fluororubber, nitrogen containing vinyl polymers, such as polyvinyl carbazole, polyvinyl pyrrolidone or a copolymer thereof, polyvinyl pyridine, and polyvinyl imidazole, diene polymers, such as polybutadiene or a copolymer thereof, polychloroprene, and polyisoprene (butyl rubber), and other ring opening polymerization type resin, condensation polymerization type resin, and natural polymer resin.

The content of the resin is preferably 1% by mass or more and 30% by mass or less and more preferably 1% by mass or more and 5% by mass or less based on the total mass (100% by mass) of the ink. When the content is within the range mentioned above, the glossiness and the abrasion resistance of a coating image to be formed can be rendered more excellent.

As resin which may be compounded in the ink, a resin dispersant, a resin emulsion, wax, and the like are mentioned, for example.

2-1. Resin Emulsion

The aqueous ink usable in the invention may also contain a resin emulsion. The resin emulsion demonstrates an effect of sufficiently fixing the ink onto the target recording medium to achieve good abrasion resistance of an image by forming a resin coating preferably with wax (emulsion) when the target recording medium is heated. Due to the above-described effect, a recorded substance on which recording is performed using the ink containing the resin emulsion achieves excellent abrasion resistance particularly on a non-ink absorbing or low-ink absorbing target recording medium.

The resin emulsion functioning as a binder is contained in the ink in the form of an emulsion. By compounding the resin functioning as a binder in the ink in the form of an emulsion, the viscosity of the ink is easily adjusted in a proper range in an ink jet recording system and excellent storage stability and discharge stability of the ink are achieved.

The resin emulsion is not particularly limited to the following substances and, for example, includes homopolymers or copolymers of (meth)acrylic acid, (meth)acrylic acid ester, acrylonitrile, cyanoacrylate, acryl amide, olefin, styrene, vinyl acetate, vinyl chloride, vinyl alcohol, vinyl ether, vinyl pyrrolidone, vinyl pyridine, vinyl carbazole, vinyl imidazole, vinylidene chloride, fluororesin, and natural resin. Among the above, at least either one of (meth)acrylic resin or styrene-(meth)acrylic acid copolymer resin is preferable, at least either one of acrylic resin or styrene-acrylic acid copolymer resin is more preferable, and styrene acrylic acid copolymer resin is still more preferable. The copolymer mentioned above may have any form of a random copolymer, a block copolymer, an alternating copolymer, and a graft copolymer.

The average particle diameter of the resin emulsion is preferably in the range of 5 nm or more and 400 nm or less and more preferably in the range of 20 nm or more and 300 nm or less in order to achieve better storage stability and discharge stability of ink.

The content of the resin emulsion among resin is preferably in the range of 0.5% by mass or more and 7% by mass or less based on the total mass (100% by mass) of the ink composition. When the content is within the range mentioned above, the solid content concentration can be reduced, and therefore better discharge stability can be achieved.

2-2. Wax

The aqueous ink usable in the invention may also contain wax. Due to the fact that the ink contains wax, more excellent fixability of the ink on non-ink absorbing and the low-ink absorbing recording media is achieved. Among wax, an emulsion type is more preferable. The wax is not particularly limited to the following substances and, for example, includes polyethylene wax, paraffin wax, and polypropylene wax, and polyethylene wax described later is preferable.

The "wax" as used in this specification means one in which solid wax particles are dispersed in water using a surfactant described later.

Due to the fact that the ink contains polyethylene wax, excellent abrasion resistance of ink can be achieved.

The average particle diameter of the polyethylene wax is preferably in the range of 5 nm or more and 400 nm or less and more preferably in the range of 50 nm or more and 200 nm or less in order to achieve better storage stability and discharge stability of the ink.

The content (in terms of solid content) of the polyethylene wax is mutually independently preferably in the range of 0.1% by mass or more and 3% by mass or less, more preferably in the range of 0.3% by mass or more and 3% by mass or less, and still more preferably in the range of 0.3% by mass ore more and 1.5% by mass or less based on the total mass (100% by mass) of the ink. When the content is within the range mentioned above, the ink can be favorably solidified and fixed also on a target non-ink absorbing or low-ink absorbing recording medium and more excellent storage stability and discharge stability of the ink are achieved.

4. Surfactant

The aqueous ink usable in the invention may contain a surfactant. The surfactant is not limited to the following substances and nonionic surfactants are mentioned, for example. The nonionic surfactant has action of uniformly spreading the ink on the target recording medium. Therefore, when ink jet recording is performed using the ink containing the nonionic surfactant, a high definition image in which blurring hardly occurs is obtained. Such a nonionic surfactant is not limited to the following substances and, for example, includes a silicon surfactant, a polyoxyethylene alkylether surfactant, a polyoxypropylene alkyl ether surfactant, a polycyclic phenyl ether surfactant, a sorbitan derivative surfactant, a fluorine surfactant, and the like, and among the above, the silicon surfactant is preferable.

The content of the surfactant is preferably in the range of 0.1% by mass or more and 3% by mass or less based on the total mass (100% by mass) of ink because better storage stability and discharge stability of the ink are achieved.

5. Water

The ink usable in the invention contains water. Water is the main solvent of the ink. When the target recording medium is heated in ink jet recording, water serves as a component which evaporates and scatters.

6. Organic Solvent

The aqueous ink usable in the invention may also contain a known volatile water-soluble organic solvent. As described above, it is preferable that the ink of this embodiment does not substantially contain glycerin (whose boiling point under one atmospheric pressure is 290° C.) which is one kind of organic solvent and does not substantially contain alkylpolyols (excluding glycerin above) whose boiling point under a pressure equivalent to one atmospheric pressure is 280° C. or higher.

7. Other Components

The aqueous ink usable in the invention may further contain an antiseptic/antifungal agent, an antirust, a chelating agent, and the like in addition to the components described above.

Aprotic Polar Solvent

It is preferable for the aqueous ink usable in the invention to contain an aprotic polar solvent. Due to the fact that the aprotic polar solvent is contained, the resin particles described above contained in the ink are dissolved, and therefore clogging of a nozzle in ink jet recording can be effectively prevented. Moreover, the aprotic polar solvent has a property of dissolving recording media, such as vinyl chloride, and therefore the adhesiveness of an image improves.

The aprotic polar solvent is not particularly limited and it is preferable to contain one or more kinds of aprotic polar solvents selected from pyrolidones, lactones, sulfoxides, imidazolidinones, sulfolanes, urea derivatives, dialkyl amides, cyclic ethers, and amide ethers. As a typical example of pyrolidones, 2-pyrolidone, N-methyl-2-pyrolidone, and N-ethyl 2-pyrolidone are mentioned. As a typical example of lactones, γ-butyro lactone, γ-valero lactone, and ϵ-capro lactone are mentioned. As a typical example of sulfoxides, dimethylsulfoxide and tetramethylene sulfoxide are mentioned. As a typical example of imidazolidinones, 1,3-dimethyl-2-imidazolidinone is mentioned. As a typical example of sulfolanes, sulfolane and dimethyl sulfolane are mentioned. As a typical example of urea derivatives, dimethyl urea and 1,1,3,3-tetramethyl urea are mentioned. As a typical example of dialkyl amides, dimethyl formamide and dimethyl acetamide are mentioned. As a typical example of cyclic ethers, 1,4-dioxane and tetrahydrofuran are mentioned. Among the above, pyrolidones, lactones, sulfoxides, and amide ethers are particularly preferable from the viewpoint of the above-described effects. 2-pyrolidone is the most preferable.

The content of the aprotic polar solvent is preferably in the range of 3% by mass or more and 30% by mass or less and more preferably in the range of 8% by mass or more and 20% by mass or less based on the total mass (100% by mass) of the ink.

Examples of Recording Method

FIG. 5

Next, a recording method of this example is described.

Figure 5:
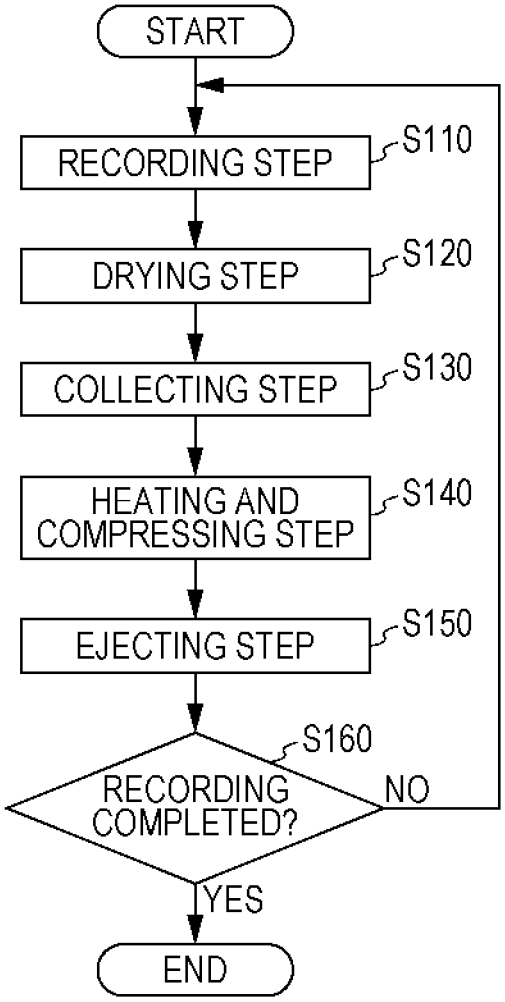
FIG. 5 is a flow chart showing Example of a recording method according to an aspect of the invention.

FIG. 5 is a flow chart illustrating the recording method of this example.

The recording method of this example is an example performed using the recording apparatus 1 of Example 1.

According to the recording method of this example, when the recording apparatus 1 inputs recording data, first, in a recording process of Step S110, recording of one scan corresponding to intermittent transportation of the target recording medium P is performed by discharging an aqueous ink to the target recording medium P from the recording head 4.

Next, in a drying process of Step S120, the aqueous ink recorded on the target recording medium P by the recording head 4 is dried by the after heater 7 and the like.

Next, in a collecting process of Step S130, vapor at least containing water evaporated from the aqueous ink in the drying process of Step S120 is collected in the heating and compressing portion 9 by driving the compression FAN 8.

Next, in a heating and compressing process of Step S140, the vapor collected in the collecting process of Step S130 is heated and compressed by the heating and compressing portion 9 by heating the vapor by the vapor heating heater 10 and also compressing the vapor by driving the compression FAN 8.

Next, in an ejecting process of Step S150, the vapor heated and compressed in the heating and compressing process of Step S140 is ejected to the target recording medium P on which recording was performed by driving the ejection FAN 11.

Next, in Step S160, it is judged whether or not recording is completed. Then, the steps of Step S110 to Step S160 are repeated until it is judged that recording is completed. When it is judged that recording is ended, the recording method according to this example is finished.

Until the portion where recording was performed on the target recording medium P reaches the drying mechanism 17, the steps of Step S120 to Step S160 are stopped. After the portion where recording was performed on the target recording medium P reaches the drying mechanism 17, the steps of Step S110 to Step S160 may be repeated.

The entire disclosure of Japanese Patent Application No. 2013-046716, filed Mar. 8, 2013 is expressly incorporated by reference herein.

What is claimed is:

1. A recording apparatus, comprising:

a recording head capable of performing recording by discharging an aqueous ink to a target recording medium;

a drying portion which dries the aqueous ink recorded on the target recording medium by the recording head;

a medium support portion that is configured to incline opposite the drying portion;

a collecting portion which collects vapor at least containing water evaporated from the aqueous ink by the drying portion;

a heating and compressing portion for heating and compressing the vapor collected by the collecting portion;

an ejecting portion for ejecting the vapor heated and compressed by the heating and compressing portion to the target recording medium on which recording is performed; and an emitting portion that is separate from the ejecting portion and that is located upstream of the collecting portion that is capable of emitting the vapor to an outside by opening a lid portion of the emitting portion such that the vapor emitted by the emitting portion is not provided to the recording medium.

2. The recording apparatus according to claim 1, wherein the aqueous ink contains a water-soluble organic solvent, and the vapor contains the water-soluble organic solvent.

3. The recording apparatus according to claim 1, wherein the recording apparatus has a transporting portion capable of intermittently transporting the target recording medium, the recording head can perform recording on the target recording medium by being carried on a carriage which can move back and forth in a direction intersecting a transporting direction of the target recording medium to scan back and forth, and the ejecting portion ejects the vapor when the target recording medium stops in the intermittent transportation of the target recording medium by the transporting portion.

4. The recording apparatus according to claim 1, wherein the recording apparatus has a transporting portion for the target recording medium, and the ejecting portion ejects the vapor to a downstream side of the heating and compressing portion in a transporting direction of the target recording medium.

5. The recording apparatus according to claim 1, wherein the heating and compressing portion includes a compression fan, and the ejecting portion includes an ejection fan.

6. A recording method, comprising:

performing recording by discharging an aqueous ink from a recording head to a target recording medium;

drying the aqueous ink recorded on the target recording medium by the recording head, wherein the target recording medium is positioned on an inclined medium support portion while the aqueous ink is being dried;

collecting vapor at least containing water evaporated from the aqueous ink by the drying;

heating and compressing the vapor collected by the collection;

ejecting the vapor heated and compressed by the heating and compression to the target recording medium on which recording is performed via an ejecting portion; and emitting the vapor to an outside via an open lid of an emitting portion that is separate from the ejecting portion such that the vapor emitted by the emitting portion is not provided to the recording medium.

7. The recording apparatus according to claim 6, further comprising:

heating and compressing the vapor collected by the collection with a compression fan; and ejecting the vapor heated and compressed by the heating and compression to the target recording medium on which recording is performed with an ejection fan.

* * * * *